US005586535A

United States Patent [19]

Syomura

[11] Patent Number: 5,586,535

[45] Date of Patent: Dec. 24, 1996

[54] ENGINE ROTATIONAL NUMBER CONTROLLER

[75] Inventor: Nobuyuki Syomura, Hamamatsu, Japan

[73] Assignee: Suzuki Motor Corporation, Japan

[21] Appl. No.: 349,412

[22] Filed: Dec. 5, 1994

[30] Foreign Application Priority Data

Dec. 16, 1993 [JP] Japan ..... 5-343384

[51] Int. Cl.[6] ..... F02D 43/04; F02D 29/02

[52] U.S. Cl. ..... 123/352; 123/336; 440/53; 440/87

[58] Field of Search ..... 123/352, 361, 123/336, 416; 440/1, 53, 87

[56] References Cited

U.S. PATENT DOCUMENTS 4,474,154 10/1984 Henning et al. ..... 123/352

4,619,232 10/1986 Morris ..... 123/352

5,172,666 12/1992 Nonaka ..... 123/352

*Primary Examiner*—Andrew M. Dolinar

*Attorney, Agent, or Firm*—Patterson & Streets, L.L.P.

[57] ABSTRACT

An engine rotational number controller includes an engine rotational number detector 5 for detecting the number of rotation of an engine, a throttle opening detector 7 for detecting a throttle opening of the engine, an ignition device 11, a stepping motor 15, an injector 16, and a control circuit 4 for delaying an ignition timing of the ignition device 11 when the number of rotation of the engine becomes higher than a predetermined upper limit in the case where the throttle number is constant and for opening a sub-throttle valve 14 of a throttle valve 12 by means of the stepping motor 15 to increase an amount of intake air and to increase an amount of injected fuel in the injector 16 when the number of rotation of the engine becomes lower than a predetermined lower limit in the case where the throttle opening is constant.

5 Claims, 8 Drawing Sheets

| FIG. 4(a) | FIG. 4(b) |
|---|---|

(LOW SPEED)

(MEDIUM SPEED)

(HIGH SPEED)

ENGINE ROTATIONAL NUMBER CONTROLLER

FIELD OF THE INVENTION AND RELATED ART STATEMENT

The present invention relates to an apparatus for controlling the number of rotation the rotational frequency) of an engine, and more particularly to an engine rotational number controller which is preferably applied to an engine of an outboard motor to control the rotational number or rotational frequency of rotation of the engine exactly.

Heretofore, as described in, for example, Japanese Patent Provisional Publication No. 303178/1992, a technique of switching an ignition timing of an engine of an outboard motor in accordance with a different ignition timing characteristic depending on a situation has been proposed. In the technique described in the above publication, a plurality of ignition timing characteristic maps having, as variables, the degrees of opening (hereinafter referred to as opening degrees or openings) of a throttle and the number of rotation of the engine which are previously calculated in consideration of a shape of a ship, the magnitude of a load, a velocity of the ship and the like are stored and an optimum ignition timing characteristic map is selected if necessary. Thus, the ignition timing of the engine of the outboard motor is switched freely and easily in accordance with a different ignition timing characteristic depending on a situation.

A shape and weight of a ship to which the outboard motor is mounted are not decided at the delivery stage from a factory. On the other hand, a sailing resistance of a ship is different depending on a shape and weight of the ship and a load imposed on an engine of an outboard motor is largely different depending on a shape of a propeller (an outer diameter, a pitch of propeller blades and the like) and the capability of the outboard motor characteristically. Accordingly, at the development stage of the outboard motor, it is necessary to perform the general-purpose settings (settlement of control constants such as an amount of injected fuel and an ignition timing) in consideration of various shapes of ships in view of the above-described characteristics of the outboard motor.

However, the above prior art has the following problems. FIGS. 5(*a*) and 5(*b*) show a draining type ship 51 (fishing vessel) having an outboard motor 50 mounted thereon and a round bottom. As shown by a curve Ka of FIG. 7, a variation ratio of a sailing resistance (a ratio of a varied sailing resistance to a varied sailing speed) of the ship is large and substantially constant without change at low, medium and high speed. Accordingly, it is possible to fix the number of rotation of an engine for various openings of a throttle valve of the engine of the outboard motor and to maintain the number of rotation of the engine to be constant by making an opening of the throttle constant.

On the other hand, FIGS. 6(*a*)–6(*d*) show a planing type ship 53 (bathboat or the like) having an outboard motor 52 mounted thereon and a square bottom. A sailing posture of the ship is different at low, medium and high speed and specifically as shown by a curve Kb of FIG. 7 a ratio of variation of a sailing resistance is largely different at the medium speed and the high speed (upon planing). In other words, the sailing resistance represented by the curve Kb is largely different from the curve Ka and an increase ratio of the sailing resistance of the planing type ship 53 is reduced in the high-speed range as compared with that of the draining type ship 51. Accordingly, when an opening of the throttle is fixed to a point indicated by E of FIG. 7 so as to maintain the number of rotation (e of FIG. 7) upon planing in order to open the throttle opening from the low and medium speed range (A→B→C→D→E→ . . . of FIG. 7) to increase the number of rotation of the engine (a→b→c→d→e→ . . . of FIG. 7) to thereby shift from the low and medium speed range to the high speed range (planing state), the sailing resistance is varied as shown by the curve Kb of FIG. 7 and accordingly even if the throttle opening is fixed without operation of the throttle, the number of rotation of the engine is gradually increased to a point (e' of FIG. 7) in which an output of the engine is balanced with the sailing resistance. More particularly, when the throttle opening is fixed to make the output of the engine constant, the sailing resistance is reduced as shown by the curve Kb and accordingly the number of rotation of the engine is increased, so that the sailing resistance is increased.

On the contrary, when the throttle opening is gradually closed from the high speed range (G→E→F→ . . . ) to reduce the number of rotation of the engine, the number of rotation of the engine becomes e' of FIG. 7. When the throttle opening is further reduced to D of FIG. 7 and is fixed so as to slightly reduce the number of rotation of the engine, the sailing resistance is changed as shown by the curve Kb of FIG. 7. Accordingly, the number of rotation of the engine is reduced to d of FIG. 7, so that the sailing speed is reduced. More particularly, in the planing type ship 53, since the ratio of variation of the sailing resistance is largely different depending on the speed of the ship, there is a defect that an unstable area of the number of rotation of the engine (the range between e and e' of FIG. 7) occurs depending on a tendency of the output of the engine.

OBJECT AND SUMMARY OF THE INVENTION

It is an object of the present invention to improve the above defect in the prior art and provide an engine rotational number controller which prevents occurrence of an unstable area of the number of rotation of the engine in which the number of rotation of the engine is increased or reduced when an opening of a throttle of the engine is constant, so that the number of rotation of the engine is stabilized.

In order to achieve the above object, the present invention is configured as follows:

The engine rotational number controller of the present invention as set forth in Claim 1 comprises means for detecting the number of rotation of an engine, means for detecting an opening of a throttle of the engine, a mechanism for varying an output of the engine, and means for controlling operation of the engine output varying mechanism on the basis of detection data of each of the detecting means, the controlling means comprising an engine output reduction control function for controlling operation of the engine output varying mechanism to reduce the output of the engine when the number of rotation of the engine becomes higher than a predetermined upper limit in the case where the throttle opening is constant and an engine output increasing control function for controlling operation of the engine output varying mechanism to increase the output of the engine when the number of rotation of the engine becomes lower than a predetermined lower limit in the case where the throttle opening is constant, whereby the above object is to be achieved.

In the engine rotational number controller of the present invention as set forth in Claim 2, the engine output varying mechanism is constituted by an ignition mechanism mounted in the engine and the engine output reduction control function or the engine output increasing control function of the control means is performed by controlling operation of the ignition mechanism to delay or advance the ignition timing, whereby the above object is to be achieved.

In the engine rotational number controller of the present invention as set forth in Claim 3, the engine output varying mechanism is constituted by a fuel injection mechanism mounted in the engine and the engine output reduction control function or the engine output increasing control function of the control means is performed by controlling operation of the fuel injection mechanism to reduce of increase an amount of injected fuel, whereby the above object is to be achieved.

In the engine rotational number controller of the present invention as set forth in Claim 4, the engine output varying mechanism is constituted by an amount-of-intake-air adjusting mechanism mounted in the engine and the engine output reduction control function or the engine output increasing control function of the control means is performed by controlling operation of the amount-of-intake-air adjusting mechanism to reduce or increase an amount of intake air, whereby the above object is to be achieved.

In the engine rotational number controller of the present invention as set forth in Claim 5, the engine output varying mechanism is constituted by an amount-of-intake-air adjusting mechanism and a fuel injection mechanism mounted in the engine and the engine output reduction control function or the engine output increasing control function of the control means is performed by controlling operation of the amount-of-intake-air adjusting mechanism to reduce or increase an amount of intake air and by controlling operation of the fuel injection mechanism to reduce or increase an amount of injected fuel, whereby the above object is to be achieved.

Operation of the present invention is described below.

According to the present invention as set forth in Claim 1, when the number of rotation of the engine becomes higher than the predetermined upper limit in the case where the throttle opening is constant, operation of the engine output varying mechanism is controlled to reduce the output of the engine, while when the number of rotation of the engine becomes lower than the predetermined lower limit in the case where the throttle opening is constant, operation of the engine output varying mechanism is controlled to increase the output of the engine. Accordingly, when the engine rotational number controller of the present invention is applied to, for example, an engine of an outboard motor, it is possible to prevent occurrence of the unstable area of the number of rotation of the engine in which the number of rotation of the engine is increased or reduced due to change of the sailing resistance of the ship when the throttle opening is constant, so that stabilization of the number of rotation of the engine can be attained.

According to the present invention as set forth in Claim 2, when the number of rotation of the engine becomes higher than the predetermined upper limit in the case where the throttle opening is constant, operation of the ignition mechanism is controlled to delay the ignition timing, or when the number of rotation of the engine becomes lower than the predetermined lower limit in the case where the throttle opening is constant, operation of the ignition mechanism is controlled to advance the ignition timing. Accordingly, occurrent of the unstable area of the number of rotation of the engine can be prevented in the same manner as in Claim 1, so that stabilization of the number of rotation of the engine can be attained.

According to the present invention as set forth in Claim 3, when the number of rotation of the engine becomes higher than the predetermined upper limit in the case where the throttle opening is constant, operation of the fuel injection mechanism is controlled to reduce the amount of injected fuel, or when the number of rotation of the engine becomes lower than the predetermined lower limit in the case where the throttle opening is constant, operation of the fuel injection mechanism is controlled to increase the amount of injected fuel. Accordingly, occurrent of the unstable area of the number of rotation of the engine can be prevented in the same manner as in Claim 1, so that stabilization of the number of rotation of the engine can be attained.

According to the present invention as set forth in Claim 4, when the number of rotation of the engine becomes higher than the predetermined upper limit in the case where the throttle opening is constant, operation of the amount-of-intake-air adjustment mechanism is controlled to reduce the amount of intake air, or when the number of rotation of the engine becomes lower than the predetermined lower limit in the case where the throttle opening is constant, operation of the amount-of-intake-air adjustment mechanism is controlled to increase the amount of intake air. Accordingly, occurrence of the unstable area of the number of rotation of the engine can be prevented in the same manner as in Claim 1, so that stabilization of the number of rotation of the engine can be attained.

According to the present invention as set forth in Claim 5, when the number of rotation of the engine becomes higher than the predetermined upper limit in the case where the throttle opening is constant, operation of the amount-of-intake-air adjustment mechanism is controlled to reduce the amount of intake air and operation of the fuel injection mechanism is controlled to reduce the amount of injected fuel, or when the number of rotation of the engine becomes lower than the predetermined lower limit in the case where the throttle opening is constant, operation of the amount-of-intake-air adjustment mechanism is controlled to increase the amount of intake air and operation of the fuel injection mechanism is controlled to increase the amount of injected fuel. Accordingly, occurrence of the unstable area of the number of rotation of the engine can be prevented in the same manner as in Claim 1, so that stabilization of the number of rotation of the engine can be attained.

DETAILED DESCRIPTION OF THE PREFERRED EMBODIMENTS

An embodiment in which the present invention is applied to an outboard motor is now described with reference to the drawings.

Figure 1:
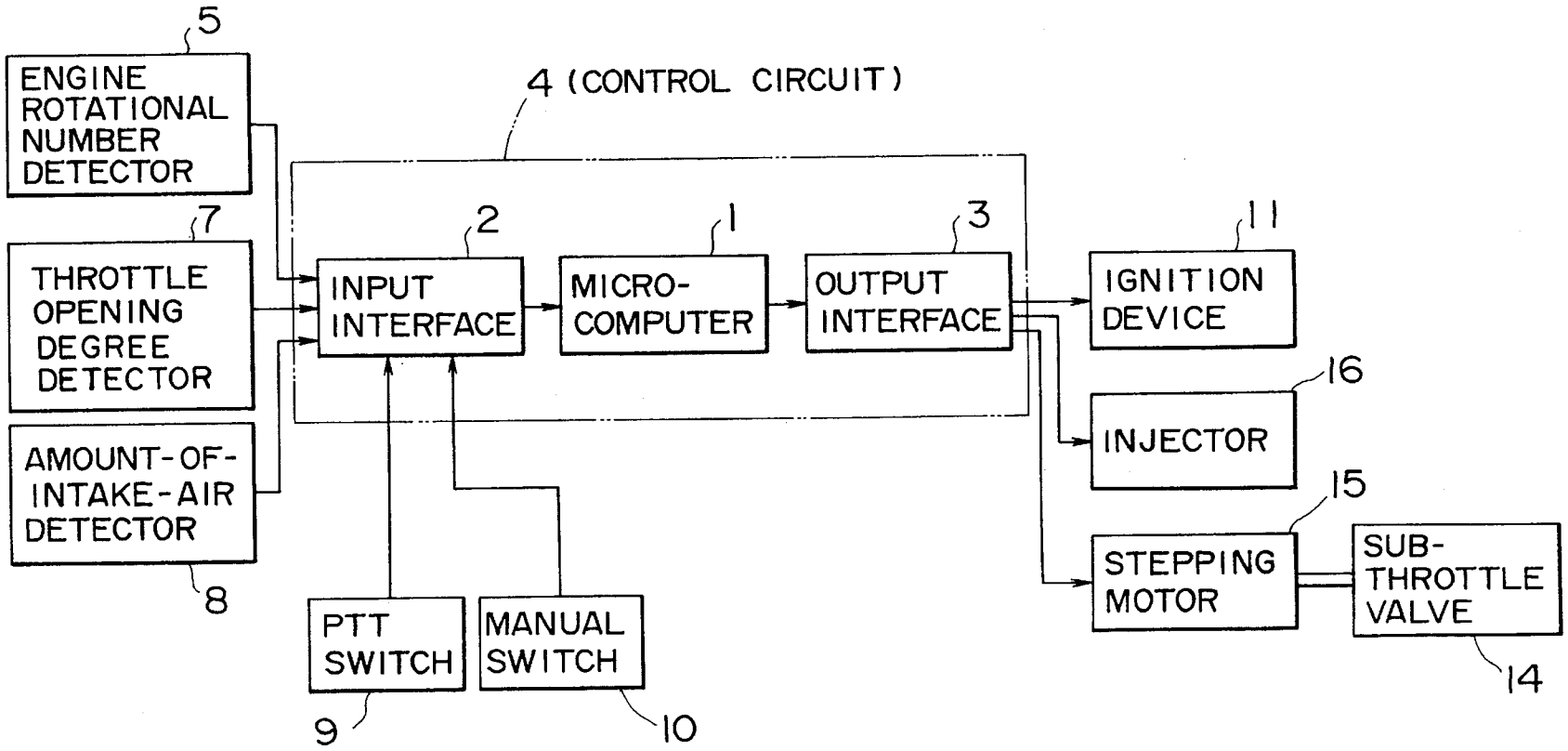
FIG. 1 is a block diagram schematically illustrating an engine control system of an outboard motor according an embodiment to which the present invention is applied.

A control system of a fuel injection type engine (hereinafter refer to as an engine simply) of an outboard motor in the embodiment is now described with reference to FIG. 1. The control system comprises a control circuit 4 including a microcomputer 1 for performing control shown in FIG. 4, an input interface 2 and an output interface 3, a detector 5 for detecting the number of rotation of the engine, a detector 7 for detecting an opening of a throttle, a detector 8 for detecting an amount of intake air, a PTT (power trimming and tilting) switch 9, a manual switch 10, an ignition device 11 constituting an ignition mechanism (engine output varying mechanism) provided with an ignition coil and an ignition plug, an injector 16 constituting a fuel injection mechanism (engine output varying mechanism), and a stepping motor 15 constituting an amount-of-intake-air adjustment mechanism (engine output varying mechanism).

Figure 2A:
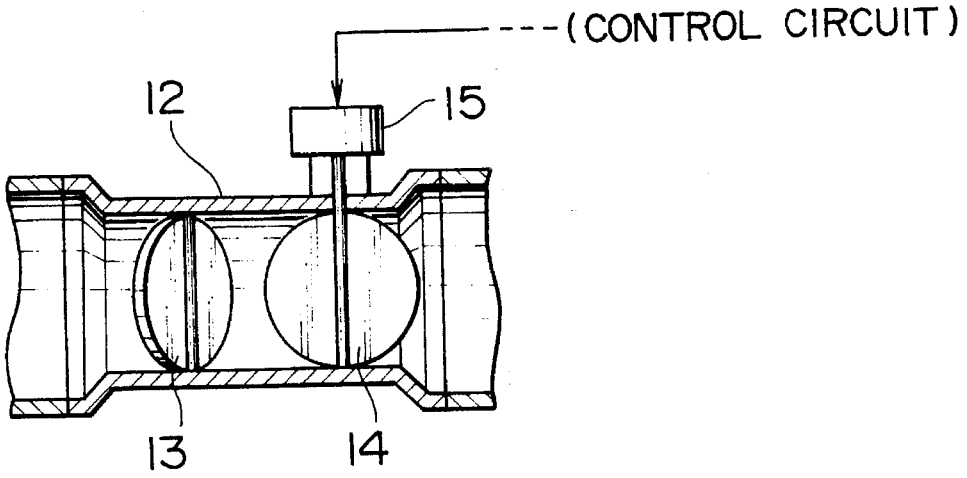
FIGS. 2(*a*) and 2(*b*) illustrate a throttle body of the engine of the outboard motor in the embodiment in which FIG. 2(*a*) is a transverse sectional view and FIG. 2(*b*) is a top sectional view.
Figure 2B:
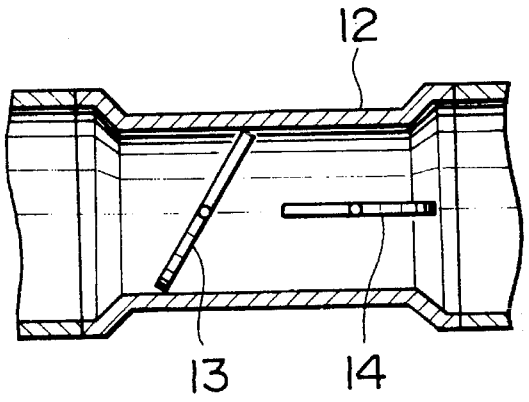

FIGS. 2(*a*) and 2(*b*) illustrate a structure of a throttle body 12 of the engine of the outboard motor. A main throttle valve 13 and a sub-throttle valve 14 are disposed within the throttle body 12. The main throttle valve 13 is adapted to be opened and closed by operation of a throttle lever by the ship operator. Further, the sub-throttle valve 14 is adapted to be opened and closed by the stepping motor 15 attached to the sub-throttle valve 14 when the output of the engine is reduced or increased by adjusting the amount of intake air in the throttle body 12.

Referring to FIG. 1 again, the engine rotational number detector 5 is adapted to detect the number of rotation of the engine of the outboard motor, the throttle opening detector 7 is adapted to detect the opening of the main throttle valve 13 in the throttle body 12, and the amount-of-intake-air detector 8 is adapted to detect the amount of intake air to the throttle body 12. In the case of an engine with a carburetor, the amount-of-intake-air detector 8 is not required. Detection signals of the detectors 5 to 8 are supplied through the input interface 2 of the control circuit 4 to the microcomputer 1.

The PTT switch 9 serves to operate and stop a PTT (power trimming and tilting) mechanism for varying a tilt angle of the outboard motor to the ship in accordance with operation of the ship operator. Further, the manual switch 10 serves to fix the number of rotation of the engine to a predetermined number of rotation in accordance with operation of the ship operator. Operation signals produced by the switches 9 and 10 are supplied through the input interface 2 of the control circuit 4 to the microcomputer 1.

The microcomputer 1 of the control circuit 4 examines the number of rotation of the engine on the basis of the detection signal of the engine rotational number detector 5 supplied through the input interface 2, examines the throttle opening on the basis of the detection signal of the throttle opening detector 7, and judges whether a control stop signal is produced by the PTT switch 9 or not (refer to FIG. 4 described later).

Further, microcomputer 1 produces a control signal to be supplied through the output interface 3 to the ignition device 11 so that control for the lag angle or for the lead angle of the ignition timing is performed to thereby reduce or increase the output of the engine (refer to FIG. 4) when the number of rotation of the engine detected by the engine rotational number detector 5 becomes higher than a predetermined upper limit (described later) or becomes lower than a predetermined lower limit in the case where the throttle opening detected by the throttle opening detector 7 is substantially constant (refer to FIG. 4).

In addition, the microcomputer 1 produces a control signal to be supplied through the output interface 3 to the stepping motor 5 and the injector 16 so that control for increasing the amount of intake air and the amount of injected fuel or control for reducing the amount of intake air and the amount of injected fuel is performed to thereby increase (refer to FIG. 4) or reduce the output of the engine when the number of rotation of the engine detected by the engine rotational number detector 5 becomes lower than the predetermined lower limit (described later) or becomes higher than the predetermined upper limit in the case where the throttle opening detected by the throttle opening detector 7 is substantially constant.

Further, the microcomputer 1 has a state flag X. In this case, the state flag X is set to "0" when the control signal indicative of operation of the PTT mechanism is produced by the PTT switch 9, when the throttle valve is varied, and when a variation of the number of rotation of the engine exceeds a set value, otherwise the state flag X is set to "1".

Figure 3:
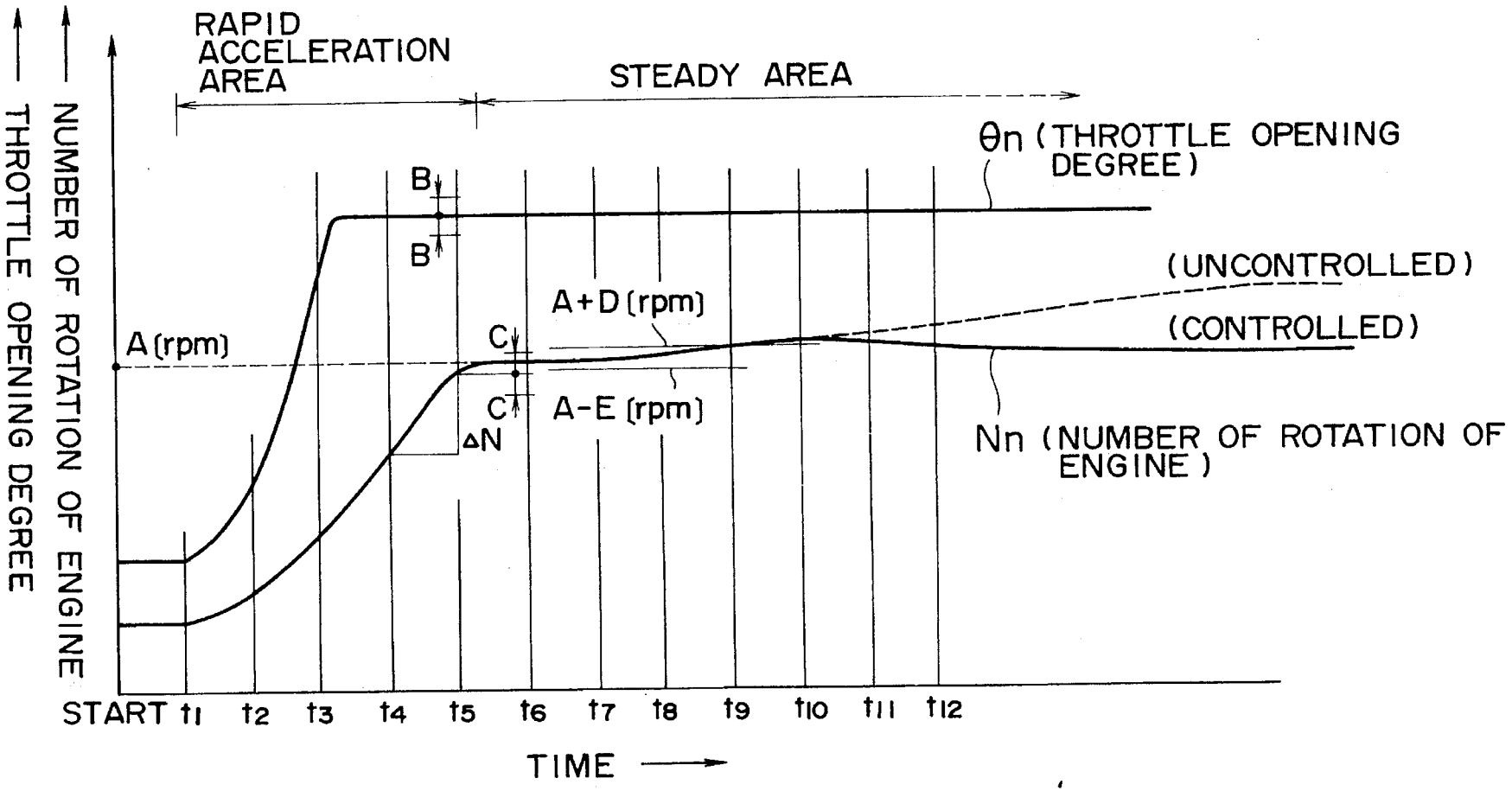
FIG. 3 is a graph showing a relation of an opening of a throttle and the number of rotation of the engine in the embodiment.

Referring now to FIG. 3, control of the output of the engine of the outboard motor by the microcomputer 1 of the control circuit 4 is now described. First of all, at time t1 just after the start of rotation of the engine, a throttle opening $\theta_n$ and the number of rotation $N_n$ of the engine are examined. At times t2 and t3 subsequent to time t1, the throttle opening $\theta_n$ is being varied and accordingly whether the control stop signal is produced by the PTT switch 9 or not is judged (refer to step S2 of FIG. 4(*a*)).

Figure 4A:
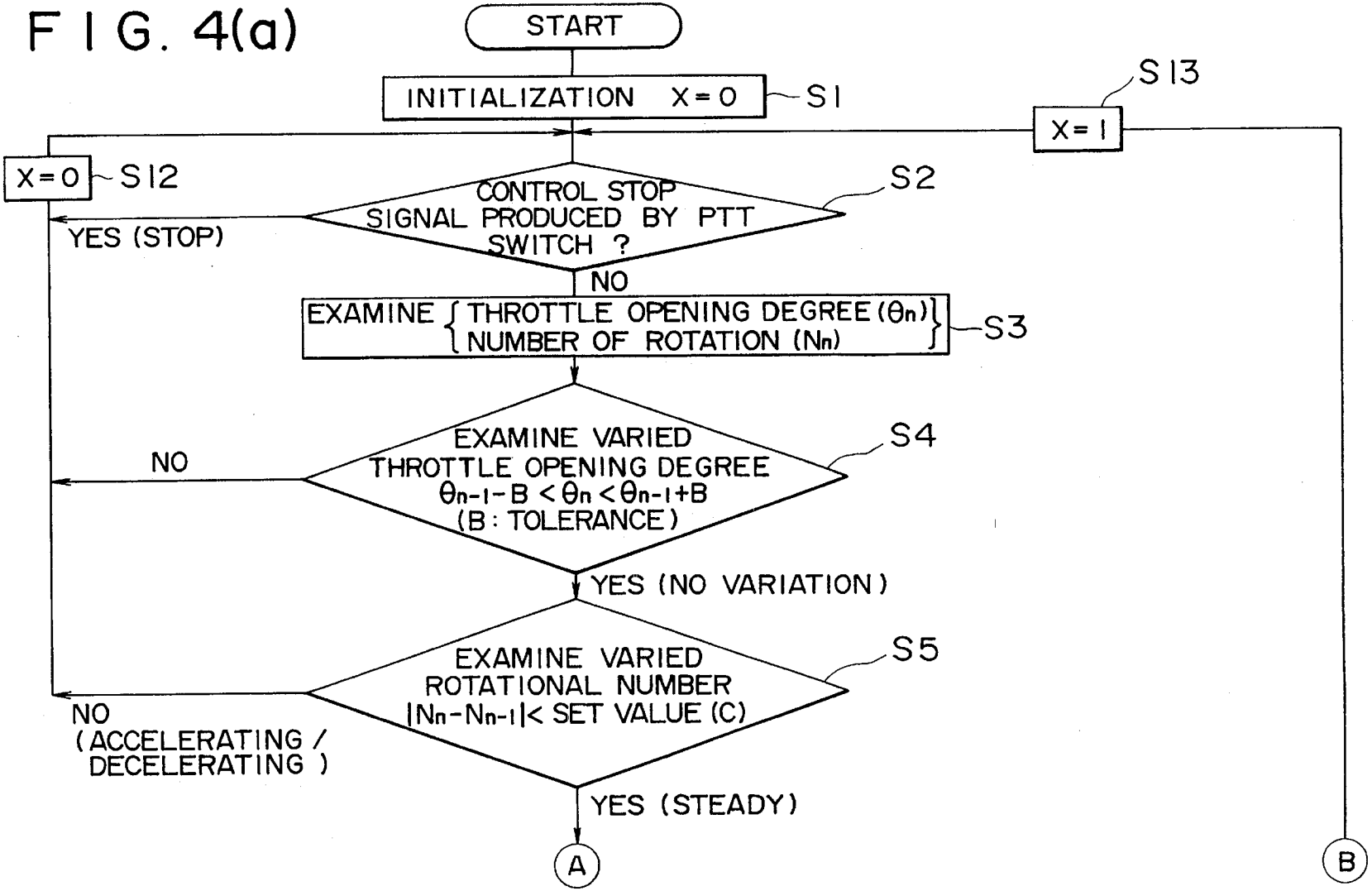
FIGS. 4, 4(*a*) and FIG. 4(*b*) are flow charts showing control of the engine in the embodiment.
Figures 4, 4B:
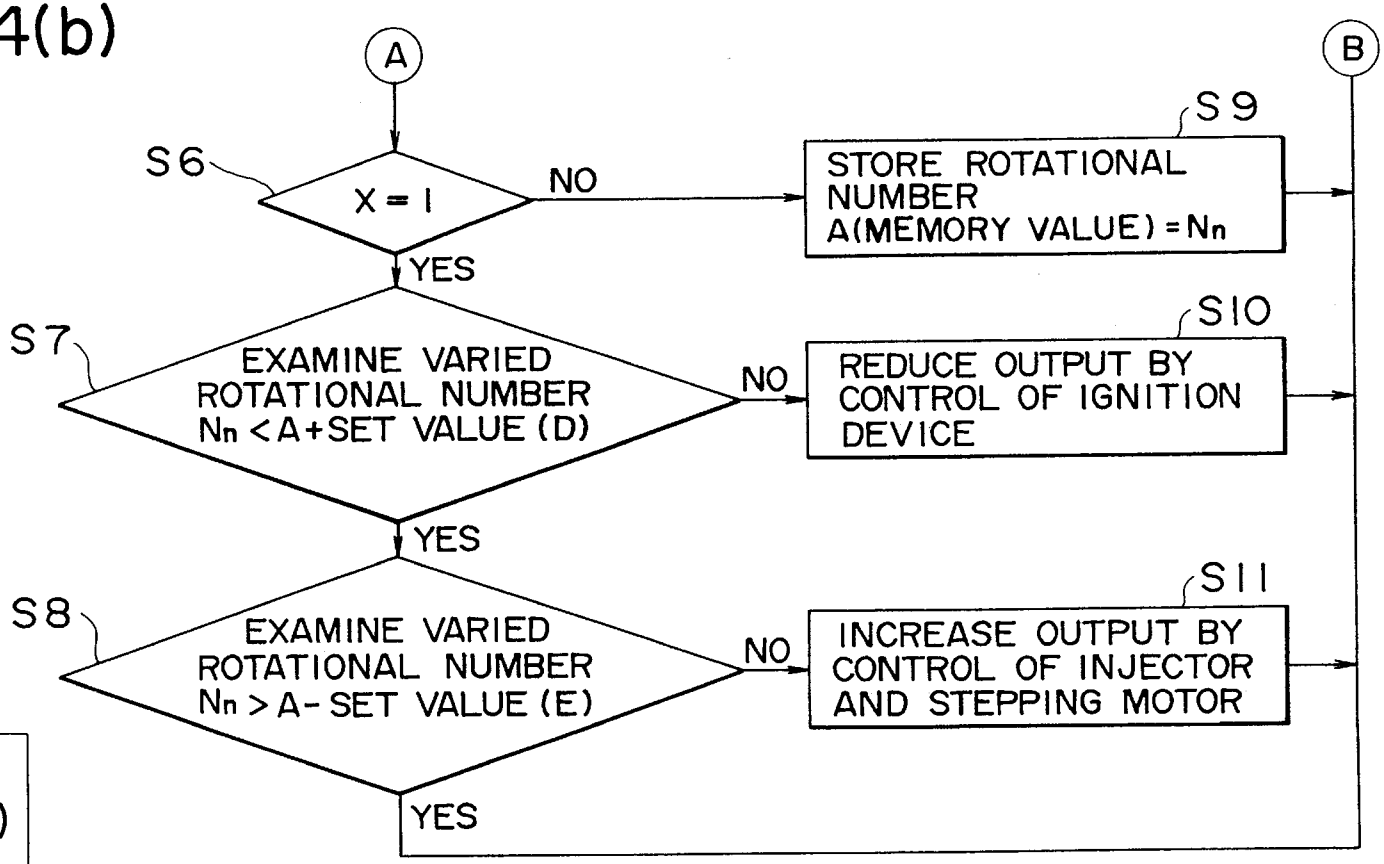
Figure 5A:
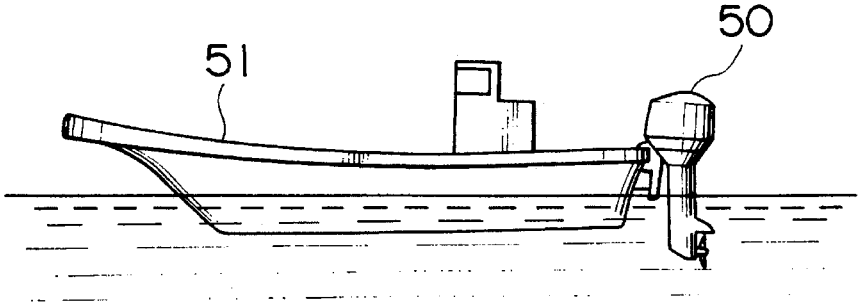
FIG. 5(a) RELATED ART
FIGS. 5(*a*) and 5(*b*) illustrates a draining type ship in which FIG. 5(*a*) is a sectional view and FIG. 5(*b*) is a rear elevation.
Figure 5B:
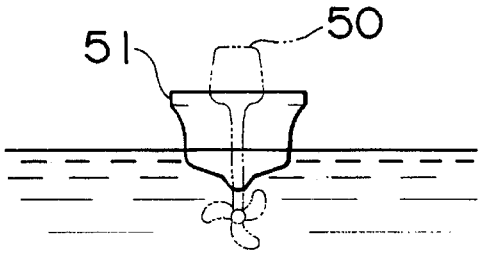
FIG. 5(b) RELATED ART
Figure 6A:
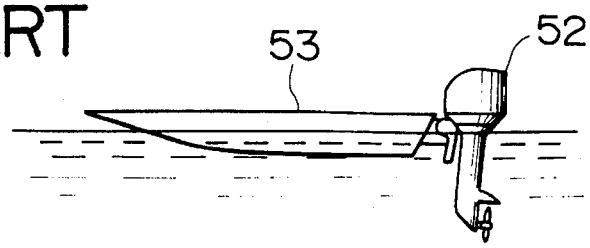
FIG. 6(a) RELATED ART
FIGS. 6(*a*)–6(*d*) illustrate a planing type ship in which FIG. 6(*a*) is a side view upon low speed sailing, FIG. 6(*b*) a side view upon medium speed sailing, FIG. 6(*c*) a side view upon high speed sailing and FIG. 6(*d*) a rear elevation.
Figure 6B:
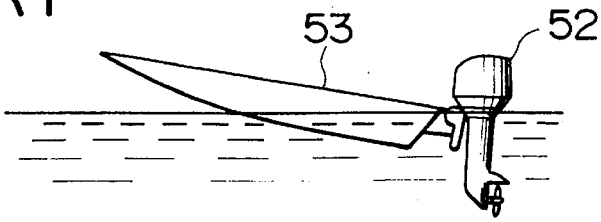
FIG. 6(b) RELATED ART
Figure 6C:
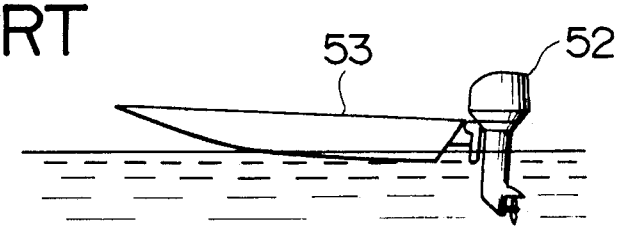
FIG. 6(c) RELATED ART
Figure 6D:
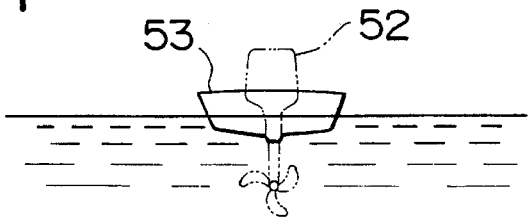
FIG. 6(d) RELATED ART

Further, at times t4 and t5, when the throttle opening $\theta_n$ is within a predetermined value (within a tolerance B), Varied Engine Rotational Number $\Delta N$>Set Value (C) where $\Delta N=|N_n-N_n-1|$ Since the varied number of rotation $\Delta N$ of the engine is increased, it is decided that the ship is being decelerated rapidly and it is judged whether the PTT switch 9 produces the control stop signal or not (refer to step S2 of FIG. 4). In this case, when the ship is decelerated rapidly, the number of rotation of the engine is varied lagging behind variation of the throttle opening.

At time t6, the varied number of rotation $\Delta N$ of the engine<the set value (C) and accordingly the number of rotation $N_n$ of the engine at the time when the number of rotation is constant is stored in an internal memory (A (memory value)=$N_n$). Thus, at times t7, t8 and t9, Engine Rotation Number $N_n$<A+Set Value (D)

Engine Rotation Number $N_n$>A−Set Value (E)

Accordingly, the output of the engine is not controlled.

At times t10 and t11, the number of rotation $N_n$ of the engine>A+the set value (D), and accordingly the control for the lag time of the ignition timing in an ignition plug of the ignition device 11 is performed to reduce the output of the engine. Further, at time t12, Engine Rotation Number $N_n$<A+Set Value (D)

Engine Rotation Number $N_n$>A−Set Value (E)

Accordingly, the output of the engine is not controlled.

More particularly, when the PTT mechanism is operated by the operation of the PTT switch 9 by the ship operator, in other words, when the ship operator varies the posture of the ship intentionally, the sailing resistance of the ship is varied and the number of rotation of the engine is varied even if the throttle opening is constant. Accordingly, the output of the engine is not controlled.

The above set value (D) is any predetermined upper limit and the set value (E) is any predetermined lower value, while when the set values (D) and (E) are too small, the output of the engine is increased or reduced to exceed the set value even by variation of a temperature of an intake air in the throttle body 12. Accordingly, in order to set the set values (D) and (E) to small values, the control may be released on the basis of the variation of the temperature of the intake air in the throttle body 12 or a predetermined correction may be added to thereby control the output of the engine with accuracy.

More particularly, in the embodiment, when the number of rotation of the engine is increased as compared with the upper limit in the case where the throttle opening is constant, the control for the lag time of the ignition timing in the ignition device 11 is performed to thereby reduce the output of the engine. In this case, as another example for reducing the output of the engine, there is the control for reducing the amount of injected fuel in the injector 16 or the control for reducing the amount of intake air in which the sub-throttle valve 14 of the sub-throttle body 12 constituting the stepping motor body 12 is closed by the stepping motor 15.

Further, in the embodiment, when the number of rotation of the engine is reduced as compared with the lower limit in the case where the throttle opening is constant, the control for increasing the amount of intake air in which the sub-throttle valve 14 of the throttle body 12 is opened by the stepping motor 15 or the control for increasing the amount of injected fuel in the injector 16 is performed to thereby increase the output of the engine. In this case, as another example for increasing the output of the engine, there is the control for the lead angle of the ignition timing in the ignition device 11.

Referring now to FIG. 4(*a*) and FIG. 4(*b*), operation of the embodiment as configured above is described.

The microcomputer 1 of the control circuit 4 mounted in the outboard motor resets the state flag X included therein and performs the initialization (step S1). Then, the microcomputer 1 judges whether the ship operator operates the PTT switch 9 or not, that is, whether the PTT mechanism is put into an operating state or not. Therefore, the microcomputer 1 judges whether the signal for stopping the controlling operation of the engine output is produced from the PTT switch 9 or not (step S2).

When the control signal is produced by the PTT switch (upon operation of the PTT mechanism), the microcomputer 1 sets the state flag X to "0" (step S12) and then returns to the judgment of the step S2. On the other hand, when the control signal is not produced by the PTT switch 9, the microcomputer 1 examines the throttle opening $\theta_n$ on the basis of the detection signal of the throttle opening detector 7 and examines the number of rotation $N_n$ of the engine on the basis of the detection signal of the engine rotation detector 5 (step S3).

In this case, when the PTT mechanism of the outboard motor is operated, the load imposed on the engine is varied so that the number of rotation of the engine is changed slowly even if the throttle opening is constant and accordingly the microcomputer 1 does not control the output of the engine.

Then, the microcomputer 1 judges whether the throttle opening $\theta_n$ satisfies the following inequality (1) or not, that is, whether the throttle opening is substantially constant or not (step S4)

$$\theta_{n-1}-B<\theta_n<\theta_{n-1}+B \quad (1)$$

where $\theta_n$ represents a throttle opening at this time, $\theta_{n-1}$ the throttle opening at the last time, B a predetermined tolerance. When the inequality (1) is not satisfied, that is, when the throttle opening is varied, the microcomputer 1 sets the state flag X to "0" (step S12) and returns to the judgment of step S2.

When the inequality (1) is satisfied, that is, when the throttle opening is substantially constant, the microcomputer 1 judges whether the number of rotation $N_n$ at this time and the number of rotation $Nn_{n-1}$ at the last time of the engine satisfy the following inequality (2) or not, that is, variation of the number of rotation of the engine is small or not (step S5).

$$|N_n-N_{n-1}|<\text{Set Value (C)} \quad (2)$$

When the inequality (2) is not satisfied, that is, when variation of the number of rotation is large, the microcomputer 1 judges that the sailing state of the ship is in the rapid acceleration state or the rapid deceleration state and sets the state flag X to "0" (step S12). Then, the microcomputer 1 returns to the judgment of step S2.

When the inequality (2) is satisfied, that is, when the variation of the number of rotation of the engine is small, the microcomputer 1 judges that the sailing state of the ship is in the stable state (not in the rapid acceleration/deceleration state) and judges whether the state flag X is "1" or "0" (step S6). When the state flag X is "0", the microcomputer 1 stores the number of rotation $N_n$ of the engine at this time in the internal memory as a memory value A (step S9). Then, the microcomputer 1 sets the state flag X to "1" (step S13) and returns to the judgment of step S2.

When the state flag X is "1", the microcomputer 1 examines whether the number of rotation $N_n$ of the engine satisfies the following inequality (3) or not, that is, examines variation of the number of rotation of the engine (step S7).

$$N_n<A+\text{Set Value (D)} \quad (3)$$

When the inequality (3) is not satisfied, the microcomputer 1 performs control for the lag angle of the ignition timing to reduce the output of the engine (step S10) and the microcomputer 1 sets the state flag X to "1". Then, the microcomputer 1 returns to the judgment of the step S2. In this case, a predetermined lower limit is previously set for the reduced output of the engine.

When the inequality (3) is satisfied, the microcomputer 1 examines whether the number of rotation $N_n$ of the engine satisfies the following inequality (4) or not, that is, examines variation of the number of rotation of the engine (step S8).

$$N_n>A-\text{Set Value (E)} \quad (4)$$

When the inequality (4) is not satisfied, the microcomputer 1 performs the increase control of the amount of intake air in which the sub-throttle valve 14 of the throttle body 12 is opened by the stepping motor 14 and the increase control of the injected fuel amount in the injector 6 to thereby increase the output of the engine (step Sll) and sets the state flag X to "1" (step S13). Then, the microcomputer returns to the judgment of step S2. In this case, a previous upper limit is set for the increased output of the engine.

When the inequality (4) is satisfied, the microcomputer 1 does not control the output of the engine and sets the state flag to "1" (step S13). Then, the microcomputer 1 returns to the judgment of step S2. The above operation is the flow of the engine output control of the embodiment.

As described above, according to the present invention, when the number of rotation of the engine is higher than the predetermined upper limit in the case where the throttle opening is constant, the ignition timing in the ignition device 11 is delayed and when the number of rotation of the engine is lower than the predetermined value in the case where the throttle opening is constant, the sub-throttle valve 14 of the throttle body 12 is opened by the stepping motor 15 to increase the amount of intake air and the amount of injected fuel by the injector 16 is increased. Accordingly, occurrence of the unstable area of the number of rotation of the engine in which the number of rotation of the engine is increased or reduced due to variation of the sailing resistance of the ship in the prior art in the case where the throttle opening of the engine of the outboard motor is constant can be prevented to thereby improve the stability of the number of rotation of the engine.

Even if the control for the lead angle of the ignition timing in the ignition device 11 is performed in order to increase the output of the engine or even if the increase control of the amount of intake air and/or the reduction control of the amount of injected fuel is performed in order to reduce the output of the engine, the same effects can be obtained.

Further, according to the embodiment, since the above-described effects can be obtained just by improvement of a portion of the system such as modification of the control program stored in the microcomputer 1, it is preferred in view of a cost.

Figure 7:
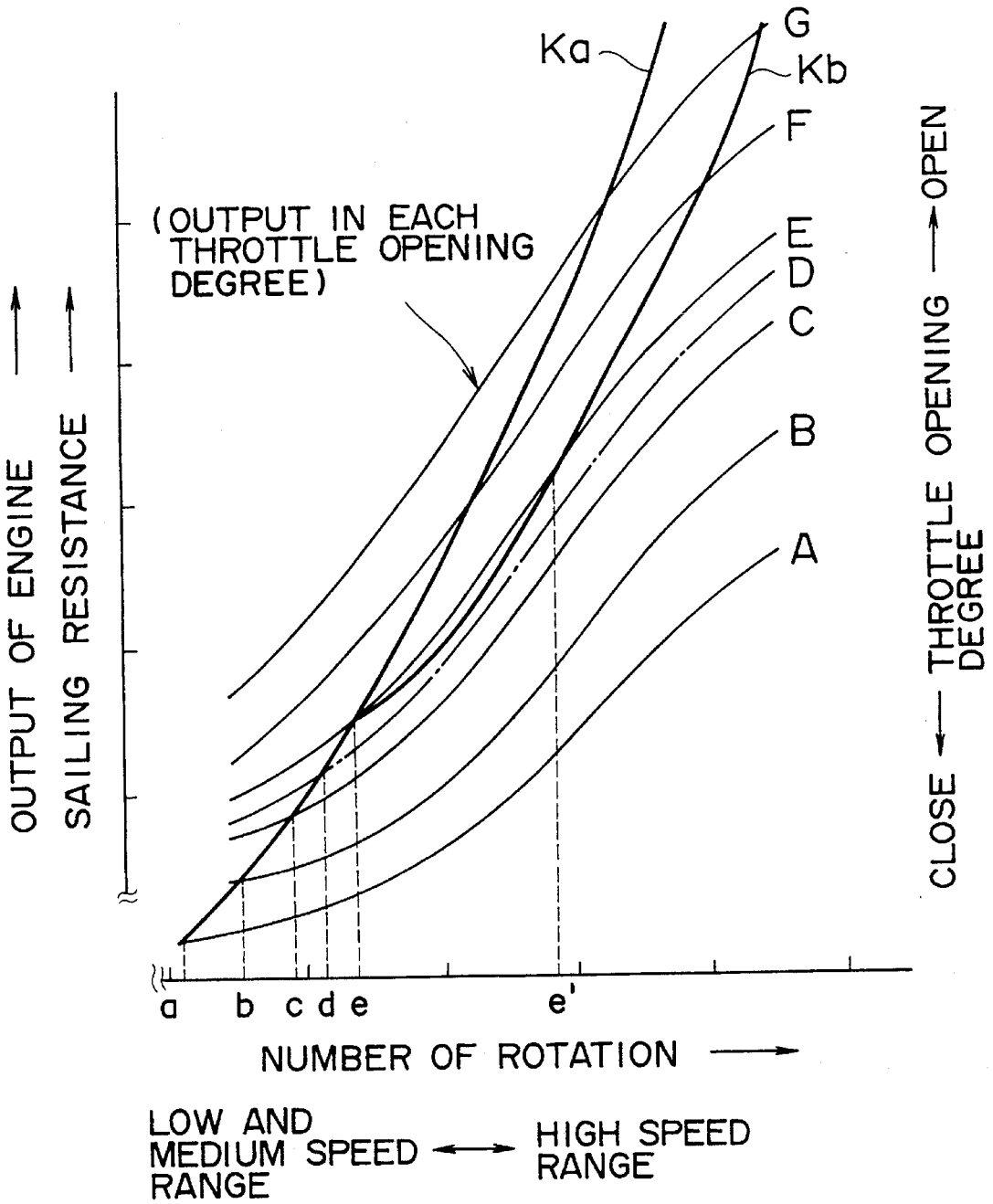
FIG. 7 RELATED ART
FIG. 7 is a graph showing a relation of sailing resistances, engine outputs, the numbers of rotation of the engine and throttle openings of the draining type ship and the planing type ship.

In this case, in the embodiment, since there is provided the switch for fixing the number of rotation of the engine of the outboard motor to the predetermined number and the ship operator can operate the switch when the throttle opening is constant, it can be prevented that the unstable area of the number of rotation of the engine as shown in FIG. 7 occurs. In other words, it is possible to perform the reduction control of the engine output or the increase control of the engine output so as to maintain the number of rotation of the engine at the time when the switch for fixing the number of rotation of the engine is turned on.

Further, in the embodiment, the fuel injection type engine to which the engine output control is applied has been described, while it can be also applied to an engine with a carburetor.

As described above, according to the engine rotational number controller of the present invention as set forth in Claim 1, when the number of rotation of the engine becomes higher than the predetermined upper limit in the case where the throttle opening is constant, operation of the engine output varying mechanism is controlled to reduce the output of the engine, while when the number of rotation of the engine becomes lower than the predetermined lower limit in the case where the throttle opening is constant, operation of the engine output varying mechanism is controlled to increase the output of the engine. Accordingly, when the engine rotational number controller of the present invention is applied to, for example, an engine of an outboard motor, it is possible to prevent occurrence of the unstable area of the number of rotation of the engine in which the number of rotation of the engine is increased or reduced due to change of the sailing resistance of the ship when the throttle opening is constant, so that stabilization of the number of rotation of the engine and the posture and the speed of the ship can be attained.

According to the engine rotational number controller of the present invention as set forth in Claim 2, when the number of rotation of the engine becomes higher than the predetermined upper limit in the case where the throttle opening is constant, operation of the ignition mechanism is controlled to delay the ignition timing, or when the number of rotation of the engine becomes lower than the predetermined lower limit in the case where the throttle opening is constant, operation of the ignition mechanism is controlled to advance the ignition timing. Accordingly, occurrent of the unstable area of the number of rotation of the engine can be prevented in the same manner as in Claim 1, so that stabilization of the number of rotation of the engine and the posture and the speed of the ship can be attained.

According to the engine rotational number controller of the present invention as set forth in Claim 3, when the number of rotation of the engine becomes higher than the predetermined upper limit in the case where the throttle opening is constant, operation of the fuel injection mechanism is controlled to reduce the amount of injected fuel, or when the number of rotation of the engine becomes lower than the predetermined lower limit in the case where the throttle opening is constant, operation of the fuel injection mechanism is controlled to increase the amount of injected fuel. Accordingly, occurrent of the unstable area of the number of rotation of the engine can be prevented in the same manner as in Claim 1, so that stabilization of the number of rotation of the engine and the posture and the speed of the ship can be attained.

According to the engine rotational number controller of the present invention as set forth in Claim 4, when the number of rotation of the engine becomes higher than the predetermined upper limit in the case where the throttle opening is constant, operation of the amount-of-intake-air adjustment mechanism is controlled to reduce the amount of intake air, or when the number of rotation of the engine becomes lower than the predetermined lower limit in the case where the throttle opening is constant, operation of the amount-of-intake-air adjustment mechanism is controlled to increase the amount of intake air. Accordingly, occurrence of the unstable area of the number of rotation of the engine can be prevented in the same manner as in Claim 1, so that stabilization of the number of rotation of the engine and the posture and the speed of the ship can be attained.

According to the engine rotational number controller of the present invention as set forth in Claim 5, when the number of rotation of the engine becomes higher than the predetermined upper limit in the case where the throttle opening is constant, operation of the amount-of-intake-air adjustment mechanism is controlled to reduce the amount of intake air and operation of the fuel injection mechanism is controlled to reduce the amount of injected fuel, or when the number of rotation of the engine becomes lower than the predetermined lower limit in the case where the throttle opening is constant, operation of the amount-of-intake-air adjustment mechanism is controlled to increase the amount of intake air and operation of the fuel injection mechanism is controlled to increase the amount of injected fuel. Accordingly, occurrence of the unstable area of the number of rotation of the engine can be prevented in the same manner as in Claim 1, so that stabilization of the number of rotation of the engine and the posture and the speed of the ship can be attained.

I claim:

1. An engine rotational number controller for an outboard engine mountable on a ship body comprising means for detecting the number of rotations of an engine, means for detecting the degree of opening of a throttle of the engine, a mechanism for varying an output of the engine, means for controlling operation of said engine output varying mechanism on the basis of detection data of each of said detecting means, power trimming and tilting means for varying a tilt angle of the outboard engine to the ship body and means for detecting cessation of operation of said power trimming and tilting means, said controlling means comprising an engine output reduction control function for controlling operation of said engine output varying mechanism to reduce the output of the engine when the number of rotation of the engine becomes higher than a predetermined upper limit in the case where the degree of opening of the throttle is constant, and an engine output increasing control function for controlling operation of said engine output varying mechanism to increase the output of the engine when the number of rotation of the engine becomes lower than a predetermined lower limit in the case where the degree of opening of the throttle is constant, and said controlling means being adapted such that the controlling operation of said engine output varying mechanism may start when said power trimming and tilting means is not operating.

2. An engine rotational number controller according to claim 1, wherein said engine output varying mechanism is constituted by an ignition mechanism mounted in the engine and said engine output reduction control function or said engine output increasing control function of said control means is performed by controlling operation of said ignition mechanism to delay or advance the ignition timing.

3. An engine rotational number controller according to claim 1, wherein said engine output varying mechanism is constituted by a fuel injection mechanism mounted in the engine and said engine output reduction control function or said engine output increasing control function of said control means is performed by controlling operation of said fuel injection mechanism to reduce of increase an amount of injected fuel.

4. An engine rotational number controller according to claim 1, wherein said engine output varying mechanism is constituted by an amount-of-intake-air adjusting mechanism mounted in the engine and said engine output reduction control function or said engine output increasing control function of said control means is performed by controlling operation of said amount-of-intake-air adjusting mechanism to reduce or increase an amount of intake air.

5. An engine rotational number controller according to claim 1, wherein said engine output varying mechanism is constituted by an amount-of-intake-air adjusting mechanism and a fuel injection mechanism mounted in the engine and said engine output reduction control function or said engine output increasing control function of said control means is performed by controlling operation of said amount-of-intake-air adjusting mechanism to reduce or increase an amount of intake air and by controlling operation of said fuel injection mechanism to reduce or increase an amount of injected fuel.

* * * * *